US010697332B2

(12) United States Patent
Cecil et al.

(10) Patent No.: US 10,697,332 B2
(45) **Date of Patent: *Jun. 30, 2020**

(54) ECCENTRIC HYDRAULIC LASH ADJUSTER FOR USE WITH COMPRESSION RELEASE BRAKE

(71) Applicant: CUMMINS INC., Columbus, IN (US)

(72) Inventors: Adam C. Cecil, Columbus, IN (US); David M. Barnes, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/303,465

(22) PCT Filed: Sep. 25, 2017

(86) PCT No.: PCT/US2017/053216

§ 371 (c)(1),
(2) Date: Nov. 20, 2018

(87) PCT Pub. No.: WO2018/063979

PCT Pub. Date: Apr. 5, 2018

(65) Prior Publication Data

US 2019/0360362 A1 Nov. 28, 2019

Related U.S. Application Data

(60) Provisional application No. 62/400,722, filed on Sep. 28, 2016.

(51) Int. Cl.
*F01L 1/24* (2006.01)
*F01L 1/26* (2006.01)
(Continued)

(52) U.S. Cl.
CPC ..... *F01L 1/2411* (2013.01); *F01L 1/181* (2013.01); *F01L 1/26* (2013.01); *F01L 1/3442* (2013.01);
(Continued)

(58) Field of Classification Search
CPC ..... F01L 1/2411; F01L 1/2416; F01L 1/26; F01L 13/065; F01L 2105/00
(Continued)

(56) References Cited

U.S. PATENT DOCUMENTS 5,632,237 A 5/1997 Cornell et al.
7,753,017 B2 7/2010 Douse et al.
(Continued)

FOREIGN PATENT DOCUMENTS

DE 10 2014 220 174 7/2015
WO 2017/160859 9/2017

OTHER PUBLICATIONS

International Search Report and Written Opinion dated Dec. 28, 2017 in Application No. PCT/US17/53216.

*Primary Examiner* — Erick R Solis
(74) *Attorney, Agent, or Firm* — Faegre Drinker Biddle & Reath LLP

(57) ABSTRACT

A valve train assembly (16) includes a fuel injector (1), an intake rocker lever assembly (10), and an exhaust rocker lever assembly (14). The intake and exhaust rocker lever assemblies (10) can include an eccentric hydraulic lash adjuster (11) that is located in the nose (31) of the respective rocker lever assemblies (10). The rocker lever assemblies (10) are configured to allow a clearance area between a nose (31) of the intake rocker lever assembly (10) and the nose (31) of the exhaust rocker lever assembly (14). As such, the fuel injector (1) can be positioned in the clearance area, while still allowing the eccentric hydraulic lash adjusters to apply a load onto a corresponding valve bridge (2). For example, the eccentric hydraulic lash adjuster (11) can include an outer housing (20) and a pivot ball (21), wherein the pivot ball (21) is positioned at an offset (23) from a lateral centerline of the outer housing (20).

20 Claims, 5 Drawing Sheets

(51) Int. Cl.
*F01L 1/18* (2006.01)
*F01L 1/344* (2006.01)
*F01L 13/06* (2006.01)

(52) U.S. Cl.
CPC ..... *F01L 13/065* (2013.01); *F01L 1/2416* (2013.01); *F01L 2105/00* (2013.01)

(58) Field of Classification Search
USPC ..... 123/90.46, 321
See application file for complete search history.

(56) References Cited

U.S. PATENT DOCUMENTS

| | | | | |
|---|---|---|---|---|
| 8,667,939 | B2 * | 3/2014 | Barnes | F01L 1/047 123/90.16 |
| 10,001,035 | B2 * | 6/2018 | Cecil | F01L 1/24 |
| 2006/0112917 | A1 | 6/2006 | Nakamura et al. | |
| 2007/0221153 | A1 | 9/2007 | Curtis | |
| 2009/0159028 | A1 * | 6/2009 | Douse | F01L 1/185 123/90.46 |
| 2011/0056447 | A1 * | 3/2011 | Astner | F01L 1/24 123/90.12 |
| 2012/0085305 | A1 | 4/2012 | Cleeves et al. | |
| 2015/0159520 | A1 * | 6/2015 | Cecur | F01L 1/267 123/90.12 |
| 2018/0119579 | A1 * | 5/2018 | Cecil | F01L 1/24 |

* cited by examiner

ECCENTRIC HYDRAULIC LASH ADJUSTER FOR USE WITH COMPRESSION RELEASE BRAKE

CROSS-REFERENCE TO RELATED APPLICATIONS

The present application is a national phase filing under 35 U.S.C. § 371 of International Application No. PCT/US2017/053216, titled "ECCENTRIC HYDRAULIC LASH ADJUSTER FOR USE WITH COMPRESSION RELEASE BRAKE," filed on Sep. 25, 2017, which claims the benefit of priority to U.S. Provisional Application No. 62/400,722, filed on Sep. 28, 2016, the entire disclosures of which being expressly incorporated herein by reference.

FIELD OF THE DISCLOSURE

The present disclosure relates generally to combustion engines and, more particularly, to combustion engine valve train assemblies.

BACKGROUND

Hydraulic lash adjusters (HLA) are common in the light duty engine market (e.g., the passenger car and light truck market) and have been for many years. The primary benefit to using this technology is that less noise is produced from the valve train because the HLA eliminates valve train clearance (lash) under all operating conditions. For example, assuming there is lash in the valve train, when the valves, such as exhaust valves, are actuated (e.g., opened), the lash is taken up as the rocker lever compresses a corresponding valve spring. On this opening event the rocker lever impacts the valve bridge due to the lash and creates noise. With an HLA there is minimum lash (e.g., no lash) so the rocker lever cannot impact the valve bridge. As modern diesel engines continue to reduce their noise, vibration, harshness (NVH) signature the valve train noise once hidden by the combustion event is now becoming more apparent. Customers are beginning to demand that the same level of NVH requirements from the light duty engine segment be integrated into midrange and heavy duty engine markets (e.g., commercial vehicle market, diesel engines greater than 6 Liter). Another benefit of HLAs is that they eliminate the typical valve adjustment process both at the assembly plant and in service reducing cost for the manufacturer and the customer. However, HLAs for the midrange and heavy duty markets are much larger in size than their light duty counterparts. The larger HLA size becomes a challenge when placing the HLA in the "nose" of the rocker lever nearest a valve, such as an exhaust or intake valve, where it competes with space for the fuel injector. Current HLA configurations are axisymmetric and, mounted traditionally, they interfere with the fuel injector. As such, there are opportunities to address the placement of HLAs in valve train assemblies.

SUMMARY

In one example, a valve train assembly includes a fuel injector, an intake rocker lever assembly, and an exhaust rocker lever assembly. The exhaust rocker lever assembly can include an eccentric hydraulic lash adjuster that is located in the nose of the exhaust rocker lever assembly. The eccentric hydraulic lash adjuster is configured to allow a clearance area between a nose of the intake rocker lever assembly and the nose of the exhaust rocker lever assembly.

As such, the fuel injector can be positioned in the clearance area, while still allowing the HLA to apply a load onto a valve bridge.

In one example, the valve train assembly includes an exhaust valve bridge configured to actuate at least one exhaust valve. The exhaust rocker lever assembly is configured to allow an offset between a lateral centerline of the exhaust valve bridge and a parallel centerline of the eccentric hydraulic lash adjuster. For example, the eccentric hydraulic lash adjuster can include an outer housing and a pivot ball, wherein the pivot ball is positioned at an offset from a lateral centerline of the outer housing. The position of the pivot ball can determine the amount of clearance area between a nose of an intake rocker lever assembly and a nose of an exhaust rocker lever assembly.

In one example, the eccentric hydraulic lash adjuster includes a locating pin configured to be inserted into a bore located in the nose of a rocker lever assembly, such as an exhaust or intake rocker lever assembly. The location of the pin, when inserted into the bore, determines the pivot ball position.

In one example, a valve train assembly includes an exhaust valve bridge configured to actuate at least one exhaust valve. For example, the exhaust valve bridge can be configured to actuate two exhaust valves. The exhaust rocker lever assembly is configured to apply a valve train load on the exhaust valve bridge. The valve train assembly also includes an intake valve bridge configured to actuate at least one intake valve. The intake rocker lever assembly is configured to apply a valve train load on the intake valve bridge. The fuel injector is positioned between the exhaust valve bridge and the intake valve bridge.

In one example, the exhaust valve bridge comprises a secondary pivot element that is operable to rotate about an exhaust valve bridge pin. The valve train assembly also includes an exhaust brake rocker lever assembly configured to apply a valve train load on the secondary pivot element of the exhaust valve bridge. In this configuration, while the fuel injector is positioned between the exhaust valve bridge and the intake valve bridge, the exhaust brake rocker lever assembly can engage the secondary pivot element of the exhaust valve bridge along a lateral centerline of the exhaust valve bridge.

In one example, both an intake rocker lever assembly and an exhaust rocker lever assembly include an eccentric hydraulic lash adjuster that is located in the nose of the respective rocker lever assemblies. Each of the eccentric hydraulic lash adjusters are configured to provide a clearance area between the nose of the intake rocker lever assembly and the nose of the exhaust rocker lever assembly. In another example, only an intake rocker lever assembly includes an eccentric hydraulic lash adjuster. In yet another example, only an exhaust rocker lever assembly includes an eccentric hydraulic lash adjuster. Other combinations are contemplated as would be recognized by one skilled in the art.

A first aspect of the present disclosure, a valve train assembly is provided that includes a fuel injector and a first rocker lever assembly comprising an eccentric hydraulic lash adjuster located in a nose of the first rocker lever assembly, wherein the first rocker lever assembly is configured to allow a clearance area between the nose of the first rocker lever assembly and a nose of a second rocker lever assembly, wherein the fuel injector is positioned in the clearance area.

In one example, the vale train assembly includes a valve bridge configured to actuate at least one valve, wherein the first rocker lever assembly is configured to allow an offset between a lateral centerline of the valve bridge and a parallel centerline of the eccentric hydraulic lash adjuster.

In another example, the eccentric hydraulic lash adjuster has an outer housing and a pivot ball, wherein the pivot ball is positioned at an offset from a lateral centerline of the outer housing. In yet another example, the eccentric hydraulic lash adjuster includes a locating pin configured to be inserted into a bore located in the nose of the first rocker lever assembly, wherein the location of the pin, when inserted into the bore, determines the pivot ball position. In still another example, the valve train assembly further includes an exhaust valve bridge configured to actuate at least one exhaust valve, wherein the first rocker lever assembly is configured to apply a valve train load on the exhaust valve bridge; and an intake valve bridge configured to actuate at least one intake valve, wherein the second rocker lever assembly is configured to apply a valve train load on the intake valve bridge, wherein the fuel injector is positioned between the exhaust valve bridge and the intake valve bridge. In still yet another example, the valve train assembly further includes an exhaust brake rocker lever assembly wherein: the exhaust valve bridge has a secondary pivot element that is operable to rotate about an exhaust valve bridge pin; and the exhaust brake rocker lever assembly is configured to apply a valve train load on the secondary pivot element of the exhaust valve bridge along a lateral centerline of the exhaust valve bridge.

A second aspect of the present disclosure, an eccentric hydraulic lash adjuster is provided that includes an outer housing; and a pivot ball, wherein the pivot ball is positioned at an offset from a lateral centerline of the outer housing. In one example, the eccentric hydraulic lash adjuster further includes a locating pin configured for maintaining correct alignment of the eccentric hydraulic lash adjuster. In another example, the eccentric hydraulic lash adjuster has a first line which defines a first plane through a center of the pivot ball, and a second line, being parallel to the first line, which defines a second plane through a center of the outer housing. In yet another example, the offset is a difference in distance between the first line and the second line.

A third aspect of the present disclosure, a valve train assembly is provided that includes a rocker lever assembly operatively connected to a valve bridge; and an eccentric hydraulic lash adjuster located in a nose of the rocker lever assembly, wherein the valve bridge of the rocker lever assembly and the eccentric hydraulic lash adjuster are spaced from each other to create an offset between the valve bridge and the eccentric hydraulic lash adjuster. In one example, the eccentric hydraulic lash adjuster has a first line which defines a first plane through a center of the valve bridge of the rocker lever assembly, and a second line, being parallel to the first line, which defines a second plane through a center of the eccentric hydraulic lash adjuster. In a variation, the offset is defined by space between the first line and the second line. In a further variation, the offset creates a clearance around the nose of the rocker lever assembly for providing space for a fuel injector.

In another example, the eccentric hydraulic lash adjuster includes an outer housing and a pivot ball connected to the outer housing. In a variation, the offset is a distance between a central longitudinal axis of the pivot ball and a central longitudinal axis of the outer housing.

In yet another example, the valve train assembly further includes an exhaust brake rocker lever assembly configured to actuate at least one exhaust valve. In a variation, the at least one exhaust valve is actuated by the valve bridge operatively connected to the rocker lever assembly. In another variation, the at least one exhaust valve is actuated by an exhaust brake button actuated via a brake element in the exhaust brake rocker lever assembly. In yet another variation, the brake element rotates about a pin connected to the valve bridge for facilitating actuation of the eccentric hydraulic lash adjuster.

BRIEF DESCRIPTION OF THE DRAWINGS

The embodiments will be more readily understood in view of the following description when accompanied by the below figures and wherein like reference numerals represent like elements, wherein.

DETAILED DESCRIPTION OF EMBODIMENTS

Figure 1:
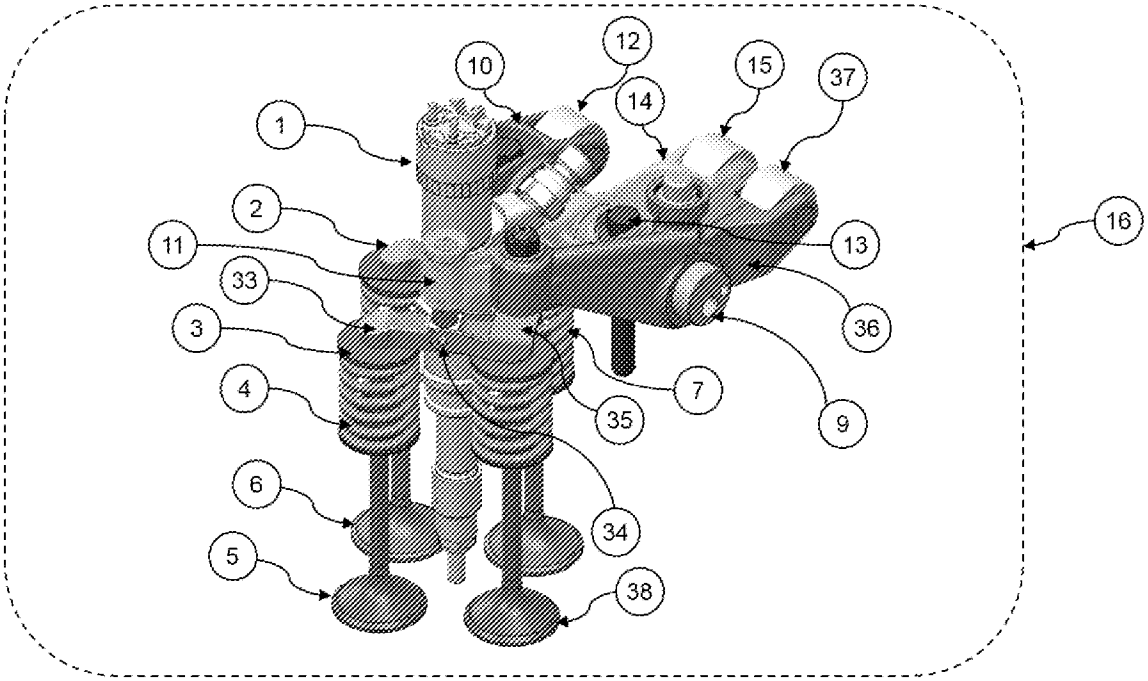
FIG. 1 is an isometric view of a fuel injector and valve train system in accordance with one example as set forth in this disclosure.

While the present disclosure is amenable to various modifications and alternative forms, specific embodiments have been shown by way of example in the drawings and are described in detail below. The present disclosure, however, is not to limit the particular embodiments described. On the contrary, the present disclosure is intended to cover all modifications, equivalents, and alternatives falling within the scope of the appended claims.

Referring to FIG. 1, a valve train assembly 16 contains an intake rocker lever assembly 10, an exhaust rocker lever assembly 14, and an exhaust brake rocker lever assembly 36. The intake, exhaust, and exhaust brake rocker lever assemblies 10, 14, 36 interface with a camshaft (not shown) via camshaft rollers 12, 15, 37. The camshaft causes the rocker lever assemblies 10, 14, 36 to pivot around the rocker lever shaft 9 which is constrained by mounting bolts 13. An eccentric hydraulic lash adjuster 11 located in the nose of each of the intake and exhaust rocker lever assemblies 10, 14 transfers the camshaft motion into applying a valve train load in the center of intake valve bridge 2 and exhaust valve bridge 33, respectively. Intake valve bridge 2 can actuate both intake valves 6 while exhaust valve bridge 33 can actuate exhaust valves 5, 38. In this example, exhaust valve bridge 33 includes secondary pivot element 35 and pin 34. In another example, exhaust valve bridge 33 can be a standard exhaust valve bridge, such as one without secondary pivot element 35 and pin 34.

The exhaust valves 5, 38 are constrained in the cylinder head (not shown) by corresponding exhaust valve springs 4, while the intake valves 6 are constrained in the cylinder head by corresponding intake valve springs 7. Each of the exhaust valve springs 4 and intake valves springs 6 are constrained by a corresponding valve retainer 3. A fuel injector 1 is located in the center of the valve train assembly. As illustrated, the fuel injector 1 is located between the respective noses of the intake and exhaust rocker lever assemblies 10, 14.

Figure 2:
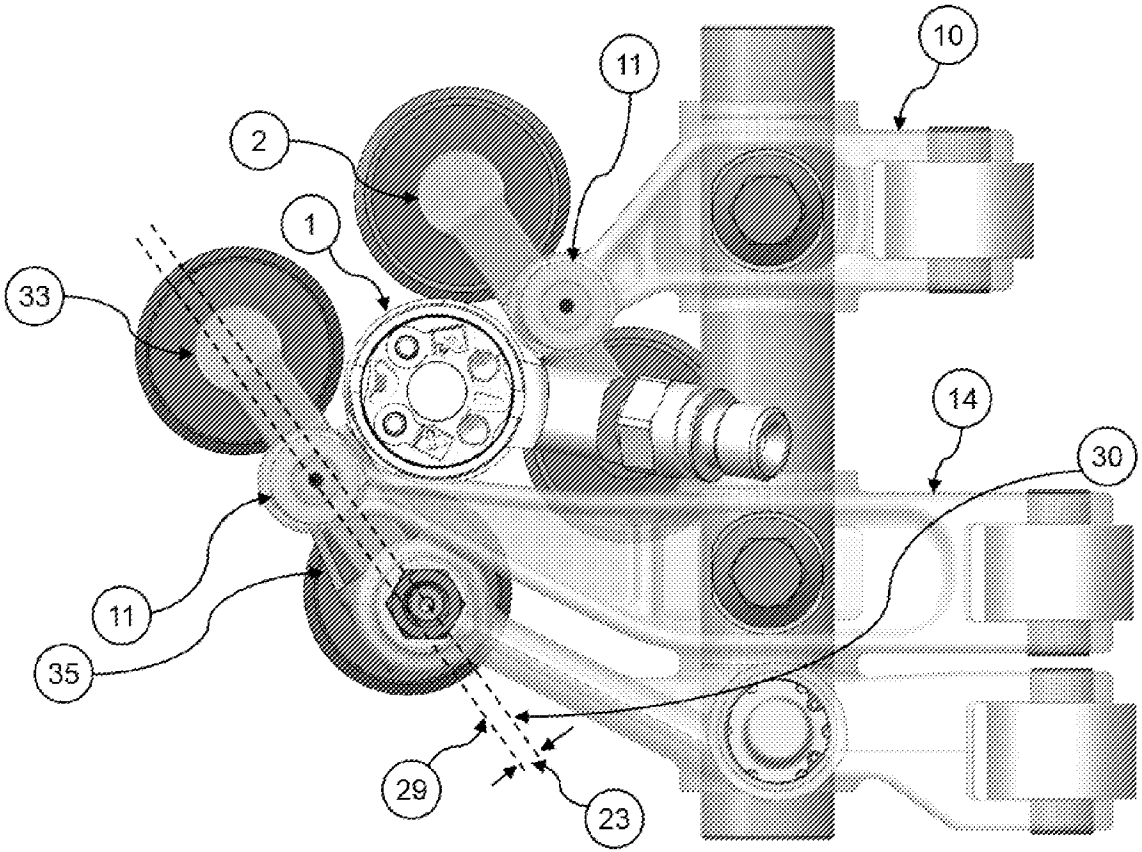
FIG. 2 is a top view of the fuel injector and valve train system of FIG. 1 in accordance with one example as set forth in this disclosure.

Exhaust valve 38 can be actuated directly by exhaust valve bridge 33 when engaged by exhaust brake rocker lever assembly 36. Actuating exhaust valve 38 via the exhaust brake rocker lever assembly 36 is known as a compression release brake event. This event can be selectively engaged by the vehicle operator to slow the vehicle down by actuating exhaust valve 38 at the end of the traditional compression event of a classic four stroke cycle, for example. This allows the engine to absorb power rather than create it FIG. 2 illustrates a top view of the fuel injector and valve train system of FIG. 1. A first line 30 is shown that defines a plane through the centerline of the exhaust valve bridge 33. A second line 29 is also shown that defines a plane through the center of the eccentric hydraulic lash adjuster 11 and is parallel to the first line 30. The spacing between first line 30 and second line 29 creates an offset 23. The offset 23 creates a clearance between the respective noses of the intake and exhaust rocker lever assemblies 10, 14 to provide space for fuel injector 1 while still allowing the intake and exhaust rocker assemblies 10, 14 to apply a valve train load in the center of the valve bridge 2, 33 via an eccentric hydraulic lash adjuster 11. Without the offset 23, the nose of the exhaust rocker lever assembly 14 would interfere with the fuel injector 1. For example, without offset 23 the eccentric hydraulic lash adjuster 11 associated with exhaust rocker assembly 14 would not allow for placement of fuel injector 1 between exhaust rocker assembly 14 and intake rocket assembly 10.

Figure 3:
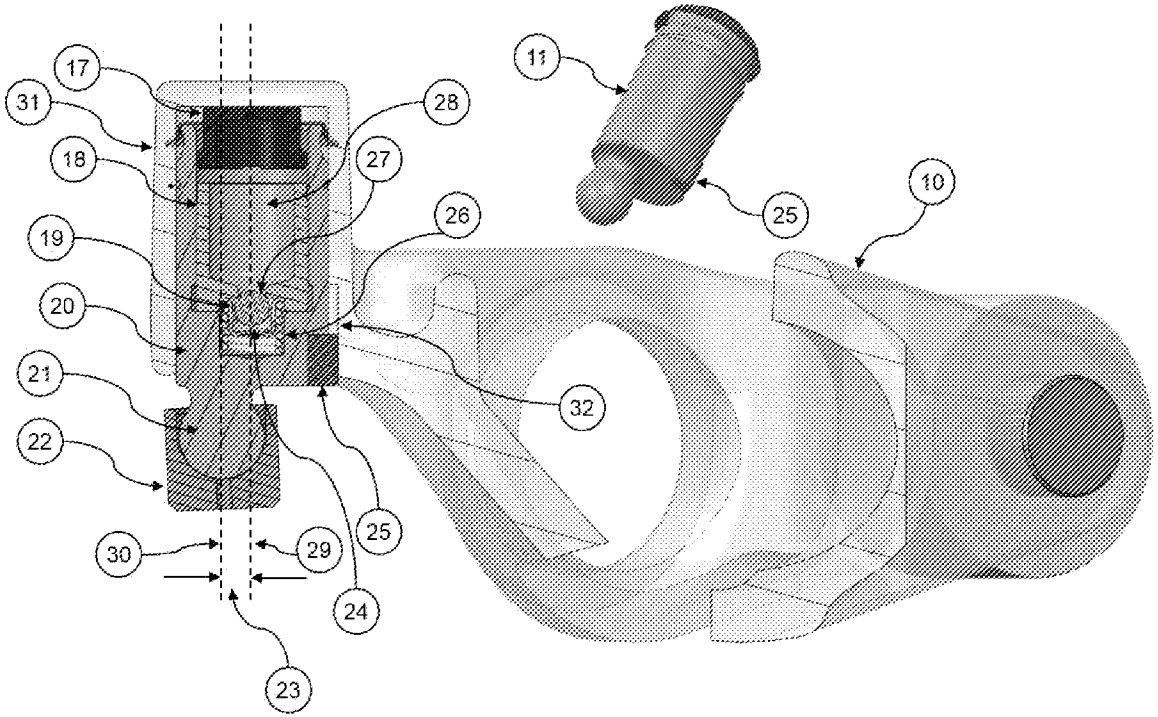
FIG. 3 is a cross-sectional view of an intake rocker lever assembly with an eccentric hydraulic lash adjuster in accordance with one example as set forth in this disclosure.

FIG. 3 illustrates an eccentric hydraulic lash adjuster 11 located in a nose 31 of intake rocker lever assembly 10 of FIG. 1. As illustrated, eccentric hydraulic lash adjuster 11 is also shown in perspective outside of intake rocker lever assembly 10. The eccentric hydraulic lash adjuster 11 includes the following components: an outer housing 20, a pivot ball 21, an inner housing 17, a plunger 18, an oil reservoir 28, a valve ball 27, a valve cap 19, a valve spring 24, and a return spring 26. A second line 29 is shown that defines a plane through the center of outer housing 20. A first line 30 is also shown that defines a plane through the center of pivot ball 21 and is parallel to the second line 29. The difference in distance between line 30 of pivot ball 21 and line 29 of outer housing 20 produces an offset 23. Offset 23 can provide for clearance between the noses of the intake and exhaust rocker lever assemblies 10, 14 as discussed above with respect to FIG. 2, thus providing space for fuel injector 1. An elephant foot 22 is used to maintain a flat interface to a valve bridge. In this example, eccentric hydraulic lash adjuster 11 includes a locating pin 25 that can be inserted into a correspondingly located bore 32 of the nose 31 of rocker lever assembly 10 to maintain correct alignment of the eccentric hydraulic lash adjuster 11 within the nose 31 of rocker lever assembly 10.

Figure 4:
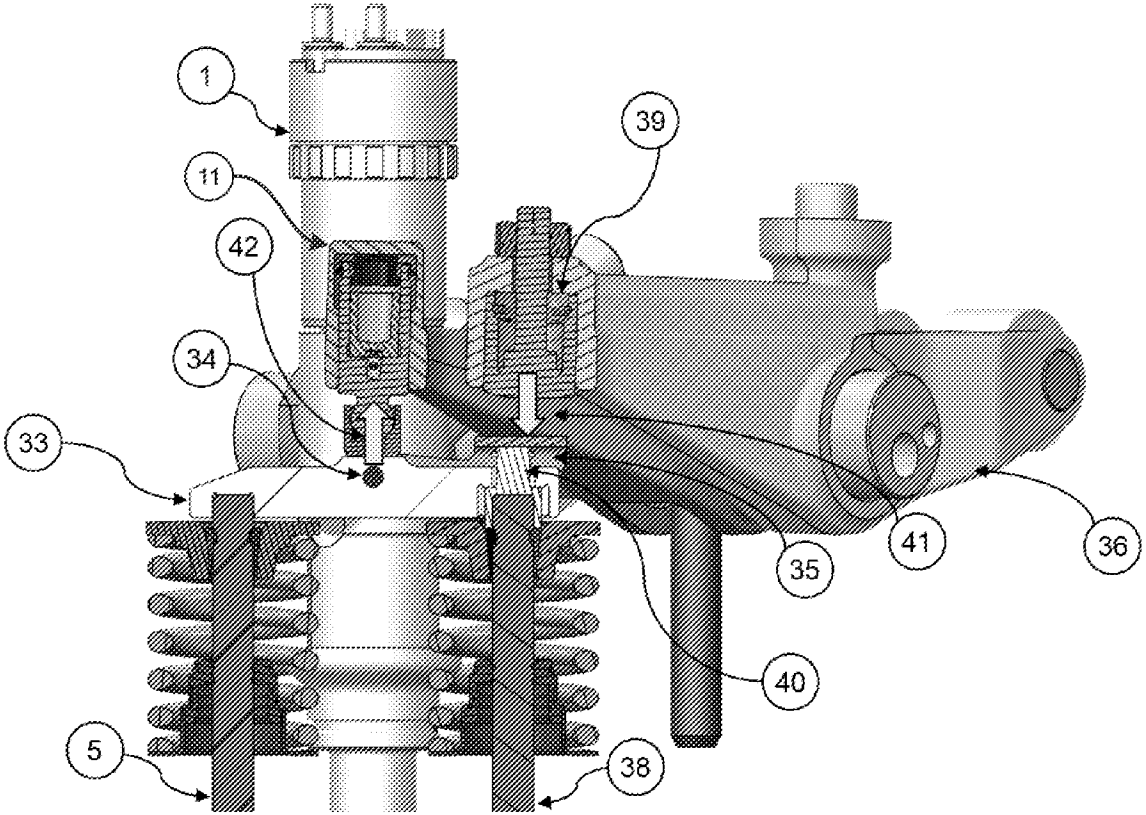
FIG. 4 is a cross-sectional view of an exhaust brake rocker lever assembly with an eccentric hydraulic lash adjuster in accordance with one example as set forth in this disclosure.

FIG. 4 illustrates a cross-sectional view of exhaust brake rocker lever assembly 36 and exhaust valve 38. Exhaust valve 38 can be actuated directly by exhaust valve bridge 33. Alternately, exhaust valve 38 can be actuated by exhaust brake button 40 independently of exhaust valve bridge 33. Exhaust brake button 40 is actuated via a hydraulic brake element 39 in the exhaust brake rocker lever assembly 36 that expands when filled with engine oil. The hydraulic brake element 39 contacts the secondary pivot element 35 along a load path defined by downward arrow 41 causing secondary pivot element 35 to rotate about a pin 34. The rotation of secondary pivot element 35 about pin 34 causes, in response, a resultant upward load path defined by an upward arrow 42 to be applied to eccentric hydraulic lash adjuster 11. This upward load prevents the hydraulic lash adjuster 11 from expanding during a compression release braking event. For example, without secondary pivot element 35 and pin 34, the valve bridge 33 would tilt during a compression release braking event causing lash between elephant foot 22 and the exhaust valve bridge 33. The eccentric hydraulic lash adjuster 11 would then expand to eliminate the lash. Once the compression release brake event is deactivated, the exhaust brake rocker lever assembly 36 will retract as the eccentric hydraulic lash adjuster 11 is still expanded thus holding exhaust valve 38 open. This could cause damage to the engine.

Figure 5:
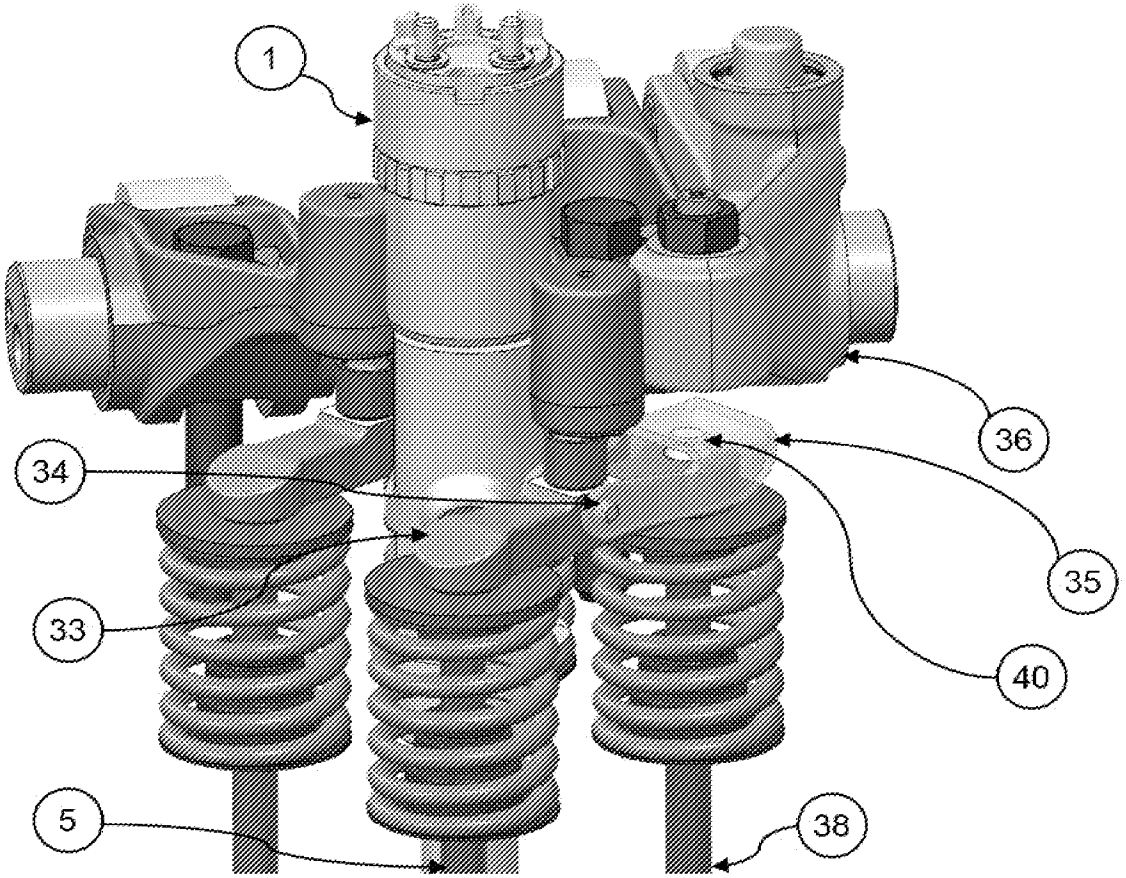
FIG. 5 is another isometric view of the fuel injector and valve train system of FIG. 4 in accordance with one example as set forth in this disclosure.

FIG. 5 illustrates a secondary view of the valve train assembly of FIG. 4 for further clarity. As illustrated, the valve train assembly includes exhaust brake rocker lever assembly 36 and fuel injector 1 which is located in the center of the valve train assembly. Exhaust valves 5, 38 are constrained in the cylinder head (not shown) by corresponding exhaust valve springs and can be actuated by valve bridge 33. Exhaust valve bridge 33 includes secondary pivot element 35 and pin 34. Alternately, exhaust valve 38 can be actuated by exhaust brake button 40 independently of exhaust valve bridge 33.

The above detailed description and the examples described therein have been presented for the purposes of illustration and description only and not for limitation. For example, the operations described can be done in any suitable manner. The methods can be performed in any suitable order while still providing the described operation and results. It is therefore contemplated that the present embodiments cover any and all modifications, variations, or equivalents that fall within the scope of the basic underlying principles disclosed above and claimed herein. Furthermore, while the above description describes hardware in the form of a processor executing code, hardware in the form of a state machine, or dedicated logic capable of producing the same effect, other structures are also contemplated.

What is claimed is:

1. A valve train assembly comprising:

a fuel injector; and a first rocker lever assembly comprising an eccentric hydraulic lash adjuster located in a nose of the first rocker lever assembly, wherein the first rocker lever assembly is configured to allow a clearance area between the nose of the first rocker lever assembly and a nose of a second rocker lever assembly, wherein the fuel injector is positioned in the clearance area.

2. The valve train assembly of claim 1, comprising a valve bridge configured to actuate at least one valve, wherein the first rocker lever assembly is configured to allow an offset between a lateral centerline of the valve bridge and a parallel centerline of the eccentric hydraulic lash adjuster.

3. The valve train assembly of claim 1, wherein the eccentric hydraulic lash adjuster comprises an outer housing and a pivot ball, wherein the pivot ball is positioned at an offset from a lateral centerline of the outer housing.

4. The valve train assembly of claim 3, wherein the eccentric hydraulic lash adjuster comprises a locating pin configured to be inserted into a bore located in the nose of the first rocker lever assembly, wherein the location of the pin, when inserted into the bore, determines the pivot ball position.

5. The valve train assembly of claim 1, comprising:

an exhaust valve bridge configured to actuate at least one exhaust valve, wherein the first rocker lever assembly is configured to apply a valve train load on the exhaust valve bridge; and an intake valve bridge configured to actuate at least one intake valve, wherein the second rocker lever assembly is configured to apply a valve train load on the intake valve bridge, wherein the fuel injector is positioned between the exhaust valve bridge and the intake valve bridge.

6. The valve train assembly of claim 5, comprising an exhaust brake rocker lever assembly wherein:

the exhaust valve bridge comprises a secondary pivot element that is operable to rotate about an exhaust valve bridge pin; and the exhaust brake rocker lever assembly is configured to apply a valve train load on the secondary pivot element of the exhaust valve bridge along a lateral centerline of the exhaust valve bridge.

7. An eccentric hydraulic lash adjuster comprising:

an outer housing; and a pivot ball, wherein the pivot ball is positioned at an offset from a lateral centerline of the outer housing.

8. The eccentric hydraulic lash adjuster of claim 7, further comprising a locating pin configured for maintaining correct alignment of the eccentric hydraulic lash adjuster.

9. The eccentric hydraulic lash adjuster of claim 7, wherein the eccentric hydraulic lash adjuster has a first line which defines a first plane through a center of the pivot ball, and a second line, being parallel to the first line, which defines a second plane through a center of the outer housing.

10. The eccentric hydraulic lash adjuster of claim 9, wherein the offset is a difference in distance between the first line and the second line.

11. A valve train assembly comprising:

a rocker lever assembly operatively connected to a valve bridge; and an eccentric hydraulic lash adjuster located in a nose of the rocker lever assembly, wherein the valve bridge of the rocker lever assembly and the eccentric hydraulic lash adjuster are spaced from each other to create an offset between the valve bridge and the eccentric hydraulic lash adjuster.

12. The valve train assembly of claim 11, wherein the eccentric hydraulic lash adjuster has a first line which defines a first plane through a center of the valve bridge of the rocker lever assembly, and a second line, being parallel to the first line, which defines a second plane through a center of the eccentric hydraulic lash adjuster.

13. The valve train assembly of claim 12, wherein the offset is defined by space between the first line and the second line.

14. The valve train assembly of claim 12, wherein the offset creates a clearance around the nose of the rocker lever assembly for providing space for a fuel injector.

15. The valve train assembly of claim 11, wherein the eccentric hydraulic lash adjuster includes an outer housing and a pivot ball connected to the outer housing.

16. The valve train assembly of claim 15, wherein the offset is a distance between a central longitudinal axis of the pivot ball and a central longitudinal axis of the outer housing.

17. The valve train assembly of claim 11, further comprising an exhaust brake rocker lever assembly configured to actuate at least one exhaust valve.

18. The valve train assembly of claim 17, wherein the at least one exhaust valve is actuated by the valve bridge operatively connected to the rocker lever assembly.

19. The valve train assembly of claim 17, wherein the at least one exhaust valve is actuated by an exhaust brake button actuated via a brake element in the exhaust brake rocker lever assembly.

20. The valve train assembly of claim 19, wherein the brake element rotates about a pin connected to the valve bridge for facilitating actuation of the eccentric hydraulic lash adjuster.

* * * * *